United States Patent [19]

Baudelet et al.

[11] 4,319,935

[45] Mar. 16, 1982

[54] SUPERPLASTIC METAL ALLOYS HAVING A HIGH DEFORMATION RATE

[75] Inventors: Bernard Baudelet, Marly; Michel Suery, Verny; Claude Homer, Metz, all of France

[73] Assignee: Pechiney Ugine Kuhlmann, Paris, France

[21] Appl. No.: 110,484

[22] Filed: Jan. 8, 1980

[30] Foreign Application Priority Data

Jan. 31, 1979 [FR] France ..... 79 03155

[51] Int. Cl.[3] ..... C22C 9/04

[52] U.S. Cl. ..... 148/32

[58] Field of Search ..... 148/32, 32.5; 75/157.5, 75/177

[56] References Cited

U.S. PATENT DOCUMENTS 3,676,115 7/1972 Hare et al. ..... 148/32

OTHER PUBLICATIONS

Garde et al., Micrograin Superplasticity in Zircaloy at 850° C., Acta Metallurgica, vol. 26, pp. 153–166, 1978.

*Primary Examiner*—R. Dean

*Attorney, Agent, or Firm*—Dennison, Meserole, Pollack & Scheiner

[57] ABSTRACT

Superplastic metal alloys having a high defromation rate are disclosed. Their structure is characterized by the presence of at least two principal constituents, the major one of which is of a particulate globular or elongated shape while the minor one surrounds the first completely or partially in the form of a particle on the boundry surface of the major constituent which is less than 10 μm thick. This invention can be applied to the shaping of alloys in the superplastic state at a high deformation rate above 100% $min^{-1}$.

1 Claim, 1 Drawing Figure

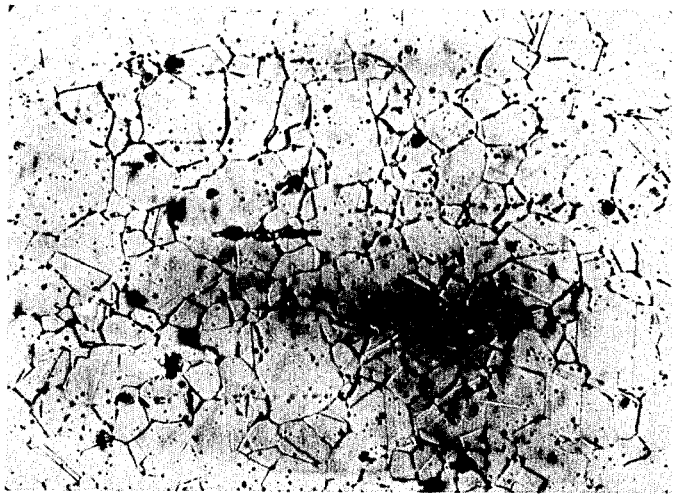

SUPERPLASTIC METAL ALLOYS HAVING A HIGH DEFORMATION RATE

BACKGROUND OF THE INVENTION

This invention relates to a novel micrographic structure for metal alloys which are superplastic in the solid state.

It is known that under certain conditions of temperature and deformation rate some alloys exhibit the phenomenon of superplasticity which is characterized by the ability to obtain a very high degree of evenly distributed deformations, >100% for example under tension, without preferential local deformations, i.e., contraction of area.

This behavior, which can be compared to the viscous deformation of synthetic resin polymers or hot glass, is generally observed under the following conditions:

(a) a deformation temperature higher than 0.5 Tf, Tf being the initial melting temperature of the alloy expressed in degrees Kelvin; and (b) very low deformation rates relative to the conventional deformation rates.

Consequently, the industrial development of such alloys has been relatively restricted since the rates adopted are very low in comparison with the normal operating rates thereof. This results in extremely long, energy-consuming operations to obtain the desired forms. In fact, for the known superplastic alloys, the rational deformation rates range from 0.1 to 10% $min^{-1}$ under optimum conditions.

Significant progress has been made in this field due to the discovery of temporary superplasticity which is induced by extremely fine recrystallation after cold working during the actual hot plastic deformation. This method is the subject of French Pat. No. 2,236,613, filed on July 3, 1973. This method allows a rational deformation rate ranging up to 100% $min^{-1}$ to be obtained temporarily. However, the temporary superplastic state has, by nature, a very short life span since the particles formed enlarge very rapidly causing the alloy to lose its capacity for rapid deformation.

This limits the practical applications, therefore, as it has to be carried out under very precise operating conditions and is awkward.

THE DRAWING

FIG. 1 is a micrographic representation of a superplastic alloy according to the invention, the scale being shown adjacent thereto.

SUMMARY OF THE INVENTION

It has been found that a more stable superplastic state allowing very high deformation rates is also observed in metal alloys having at least two principal constituents, the quantity of one constituent greatly exceeding that of the other. Each constituent can be either a phase in the crystallographic sense, in which case the alloy is at least two-phase, or distinct micrographic constituents formed from several phases, i.e., solid solution + very small precipitates, eutectics, eutectoid, etc. or both.

The structure of the alloy according to the invention has one or more of the following characteristics.

A designates the major constituent and b the minor constituent:

(1) constituent A has, in a micrographic section, a generally globular or elongated particle form, length to width ratio < 20, surrounded at least partially by constituent b in the form of a generally elongated particle on the boundry surface of constituent A;

(2) constituent A is less ductile than constituent b at the deformation temperature; and (3) the total length of constituent b, determined over a micrographic section, which is assumed to be of negligible thickness is greater than 30% of the total length of the joints between the particles of constituent A, excluding macle joints.

The structural characteristics of the alloy are determined in the following manner:

(a) width of constituent b = method involving micrographic intersections on a magnification of from 500 to 1000 as described in the work "Microscopic quantitative" by R. T. Dehoff and F. N. Rhines, Masson et Cie, 1971; and (b) the relative length of constituent b is determined by measuring the lengths by micrography on a magnification of from 500 to 1000. The relative ductilities of constituents A and b can be evaluated by any known method, such as by the hardness or microhardness, elongation during a tensile test, deformation rate under a given stress, etc. It has been found that the width of constituent b must be quite small, and generally less than 10 μm, preferably 5 μm and even 1 μm.

These structures can be obtained by any conventional metallurgical method, for example:

(i) thermal or thermomechanical treatment of cast, wrought or sintered alloys, (ii) intergranular diffusion in the solid state of a third element, (iii) powder metallurgy, etc.

It is known that if the equation of the mechanical state is expressed by the formula:

$$\sigma = K\epsilon N\dot{\epsilon}m$$

in which, $\sigma$ represents the stress

K represents a constant $\epsilon$ represents the rational deformation ( for a tensile test $\epsilon$ = Log l/lo, l being the length during testing, of a sample having an initial length lo; Log: Napierian Logarithm), $\dot{\epsilon}$ represents the deformation rate = $(\epsilon/\tau)$ T N represents the cold working coefficient, close to zero, m represents the index of sensitivity to the deformation rate, the superplastic state is generally observed at a value for m which is higher than 0.2, preferably 0.3.

The following examples will allow better understanding of the invention without limiting the scope thereof.

EXAMPLE 1

A 2.5 mm diameter tensile sample was machined from a 3 mm diameter previously annealed "Zircaloy 4" wire and was brought to 850° C by H.F. heating during a hot tensile test.

The final structure after this test was as follows:

% by volume $\alpha$ = 75 (constituent A)

% by volume $\beta$ = 25 (constituent b)

average particle size $\alpha$ = 7 μm average thickness of the $\beta$ phase = 1.8 μm relative length of the $\beta$ phase = 40%

The test was carried out, in part, under a constant stress of 35 MPa the rational deformation rate of $\dot{\epsilon}$ = 150% $min^{-1}$.

The coefficient (m) determined by the method of abrupt variation in the stress was found to be 0.4, which is indeed characteristic of the superplastic state. The uniform elongation exceeded 100% without the phenomenon of contraction in area.

EXAMPLE 2

A 4 mm diameter brass wire $\alpha$ (Cu Zn 36 according to French AFNOR specification No. A51 101 April 1976) which had initially been cold worked by 96% was subjected to a rapid thermal treatment in the $\alpha + \beta$ two phase range. This latter treatment which is effected by H.F. heating involves a rise to 790° C in 3 seconds and maintenance at this temperature for 2 seconds before water quenching.

This temperature of 790° C is about 40° C above the transitional temperature $\alpha \rightleftarrows \alpha + \beta$ of the alloy under consideration in the Cu-Zn binary graph, cf. Hansen, Constitution of binary alloys, 1958, p.. 650.

The structure obtained is illustrated in FIG. 1 and is characterized by the following values:

% by volume $\alpha$ phase = 90 (constituent A)
% by volume $\beta$ phase = 10 (constituent b)
average thickness of the edging of $\beta$ : 0.4$\mu$m
relative length of the edging $\beta$ : 80%

During a creep test at 800° C under a constant stress of 13 MPa, the rational deformation rate was $\dot{\epsilon}$ =300% $min^{-1}$.

The index of sensitivity to the deformation rate (m) determined as in Example 1 was found to be 0.54.

The deformation rates obtained in this way are at least 30 times those observed on the conventional superplastic materials and are more than three times higher than those of materials exhibiting temporary induced plasticity.

We claim:

1. A superplastic brass alloy comprising at least two solid state phases comprising a major alloy constituent in globular or elongated particulate form having a minor alloy constituent on the boundry surfaces of the particles of the major constituents, said alloy consisting essentially of copper within the range of about 62.0–65.5% by weight with the balance zinc and up to 0.4% impurities.

* * * * *